US005294144A

United States Patent [19]

Stepanek et al.

[11] Patent Number: 5,294,144

[45] Date of Patent: Mar. 15, 1994

[54] HYDRAULIC SKI BINDING INCORPORATING ELECTRONICALLY-CONTROLLED BYPASS

[75] Inventors: Premek Stepanek, Garmisch-Partenkirchen; Gerhard Sedlmair, Farchant, both of Fed. Rep. of Germany

[73] Assignee: Marker Deutschland GmbH, Eschenlohe, Fed. Rep. of Germany

[21] Appl. No.: 943,305

[22] Filed: Sep. 10, 1992

[30] Foreign Application Priority Data

Sep. 10, 1991 [DE] Fed. Rep. of Germany ... 9111214[U]

[51] Int. Cl.[5] ..... A63C 9/088

[52] U.S. Cl. ..... 280/612; 280/613

[58] Field of Search ..... 280/612, 613, 627, 633, 280/634, DIG. 13

[56] References Cited

U.S. PATENT DOCUMENTS

| | | | |
|---|---|---|---|
| 3,820,803 | 6/1974 | Frisch et al. | 280/612 |
| 3,893,684 | 7/1975 | Schweizer | 280/634 |
| 4,280,714 | 7/1981 | Salomon | 280/612 X |
| 4,291,894 | 9/1981 | D'Antonio et al. . | |
| 4,398,747 | 8/1983 | Bernard et al. | 280/630 |
| 4,436,321 | 3/1984 | Storandt et al. | 280/612 |
| 4,482,168 | 11/1984 | Oberleitner | 280/612 |
| 4,516,791 | 5/1985 | Riss et al. | 280/612 |
| 4,545,598 | 10/1985 | Spitaler et al. | 280/612 |
| 4,589,673 | 5/1986 | Dimier et al. | 280/630 |
| 4,715,132 | 12/1987 | Pozzobon | 280/613 |
| 4,728,115 | 3/1988 | Pozzobon et al. | 280/613 |

FOREIGN PATENT DOCUMENTS

| | | | |
|---|---|---|---|
| 373159 | 12/1983 | Australia . | |
| 0039003 | 11/1981 | European Pat. Off. | 280/DIG. 13 |
| 3307033C2 | 9/1992 | Fed. Rep. of Germany . | |
| 1131521 | 12/1984 | U.S.S.R. | 280/613 |

*Primary Examiner*—Brian L. Johnson

*Attorney, Agent, or Firm*—D. Peter Hochberg; Mark Kusner; Michael Jaffe

[57] ABSTRACT

A hydraulic ski binding comprises a hydraulic fluid-containing cylinder divided into two spaced-apart chambers by a piston attached to a piston rod, the piston and cylinder being slidable relative to each other, and either the cylinder or piston rod being associated with ski boot attachment structure to connect a ski boot to a ski. The attachment structure is biased by a spring into its ski boot attachment mode. Shock-absorbing structure is provided comprising ducts connecting the chambers, one including a check valve, another a choke, and a further a shut-off valve. Battery-powered electronic circuitry is provided which includes transducers, the circuitry opening the shut-off valve by activating an electromagnet associated therewith when a predetermined force acting on the binding is detected by the transducers. When the shut-off valve is thus opened, the shock-absorbing structure provided by the choke is, in effect, deactivated, allowing the spring to control release of the ski boot directly.

10 Claims, 2 Drawing Sheets

HYDRAULIC SKI BINDING INCORPORATING ELECTRONICALLY-CONTROLLED BYPASS

TECHNICAL FIELD

The invention relates to safety ski bindings having a sole holder biased by a release spring, which are combined with a hydraulic shock absorber device comprising a choke and a check valve. The bindings have electronic circuitry adapted to respond to signals provided by at least one transducer designed to sense forces and/or moments acting on the leg of a skier using the bindings, and they are provided with an electromagnet and a battery.

BACKGROUND ART

Safety ski bindings of the foregoing type are, for instance, described in German Patent 3,307,003 A1 in which when the ski boot is not inserted into the binding, a choke included therewith is positioned in a mode in which its cross-section is at a maximum. When the ski boot is placed in the binding, however, the electronic circuitry is activated and a blocking member, actuated by an electromagnet, causes a reduction of the choke's cross-section. In its latter condition, the cross-section constitutes a reference control value.

The release spring of such a binding is designed so that it opposes the release forces acting on the sole holder of the binding with the minimum resistance required for skiing, the cross-sections of the ducts associated with the bindings being suitably dimensioned to ensure the attainment of a small shock-absorbing effect independent of the choke. Additional forces transmitted by the ski boot to the sole holder or to the ski, that is forces which do not directly act on the sole holder with a releasing effect, are detected by sensors and lead to an increase in the passage cross-section, and thus to a reduction of the choke's resistance to the flow of hydraulic fluid therethrough. In this way there is a regulation or automatic control of the overall resistance to binding release which is dependent on the loads being experienced by the bindings.

If as a consequence of some failure, the electromagnet is not supplied with the appropriate electric current, a return spring presses the blocking member back so that the maximum passage cross-section is reset to a value greater than the reference control value. This condition is even more hazardous for well-trained, expert skiers, however, since unintended releases may result, with the consequence that non-typical accidents and resultant injuries can occur to the skier.

If on the contrary there is a malfunction of the electronic circuitry such that there is no necessary decrease in current to the electromagnet to accommodate a load, no desired reduction of the damping resistance of the choke occurs, and the skier may experience an overloading of his or her leg and thus suffer a typical skiing injury.

With reference to the general state of the art concerning safety ski bindings with hydraulic components, reference may also be had to the Austrian Patent 373,159 as one of a series of publications.

SUMMARY OF THE INVENTION

The main object of the present invention is to preclude hazards of the type described in the preceding.

Such result is attained by the provision of a bypass duct for the check valve and/or the choke of the system, and of a shut-off valve located in the bypass duct which is operated by the magnet. In such case, there is no provision for changing the cross-section of the choke passage during skiing. As a result, neither is there any need for the continuous supply of current to the electromagnet during operation, which requires an undesirably large consumption of energy.

Unlike the prior art initially described herein, in the safety ski binding of the invention, one or more sensors are provided which detect at least the forces acting in the release direction on the sole holder. The resulting signals of the sensors are processed in associated circuitry and compared with a threshold value, preset in accordance with the desired release characteristic. When the threshold release value is attained the magnet is energized and the shut-off valve opened.

If a defect should occur in the system's circuitry, or in the electromagnet in the safety ski binding provided in accordance with the invention, or if the current supply should fail, the binding will maintain generally the same release characteristic or function, this being especially significant in the case of dynamic loadings. The binding will then function purely hydromechanically.

With respect to the design of the present invention, it is possible for the shock-absorbing device to comprise a piston and cylinder arrangement, the piston being connected to a piston rod which is loaded by the release spring and whose free end takes the form of a catch member functioning as a sole holder. In the conventional manner, the catch member is arranged to cooperate with a catch recess which preferably has release cams configured for different directions of loading.

In accordance with a modified design, the shock-absorbing device has a piston and cylinder arrangement, the cylinder being mounted in a sliding manner on the piston for motion relative to the release spring. The piston not only contains the choke and the check valve, but also the bypass duct and the shut-off valve. This design makes possible a compact, and therefore sturdy and reliable construction. Preferably, the free end of the cylinder is embodied in the form of a catch member, functioning as the sole holder.

The design of the safety ski binding's sole holder in accordance with the invention is such as to accommodate ski boots with different sorts of soles, and may be in any conventional form. In accordance with one advantageous modification, the sole holder loaded by the release spring is movably mounted on, or in the ski boot sole. This means that the safety ski binding, with its main component, is able to be accommodated in the sole of the ski boot, and is therefore protected. The ski must then only mount simple holding elements without a safety function, and if desired, may be designed so that the only motion in relation to the sole holder is that required for deliberate release when a release is specifically intended.

BRIEF DESCRIPTION OF THE DRAWINGS

The present invention is better understood with reference to the accompanying drawings wherein.

DESCRIPTION OF THE PREFERRED EMBODIMENT

The invention is described in more detail with reference to one possible embodiment thereof in the following.

Figure 1:
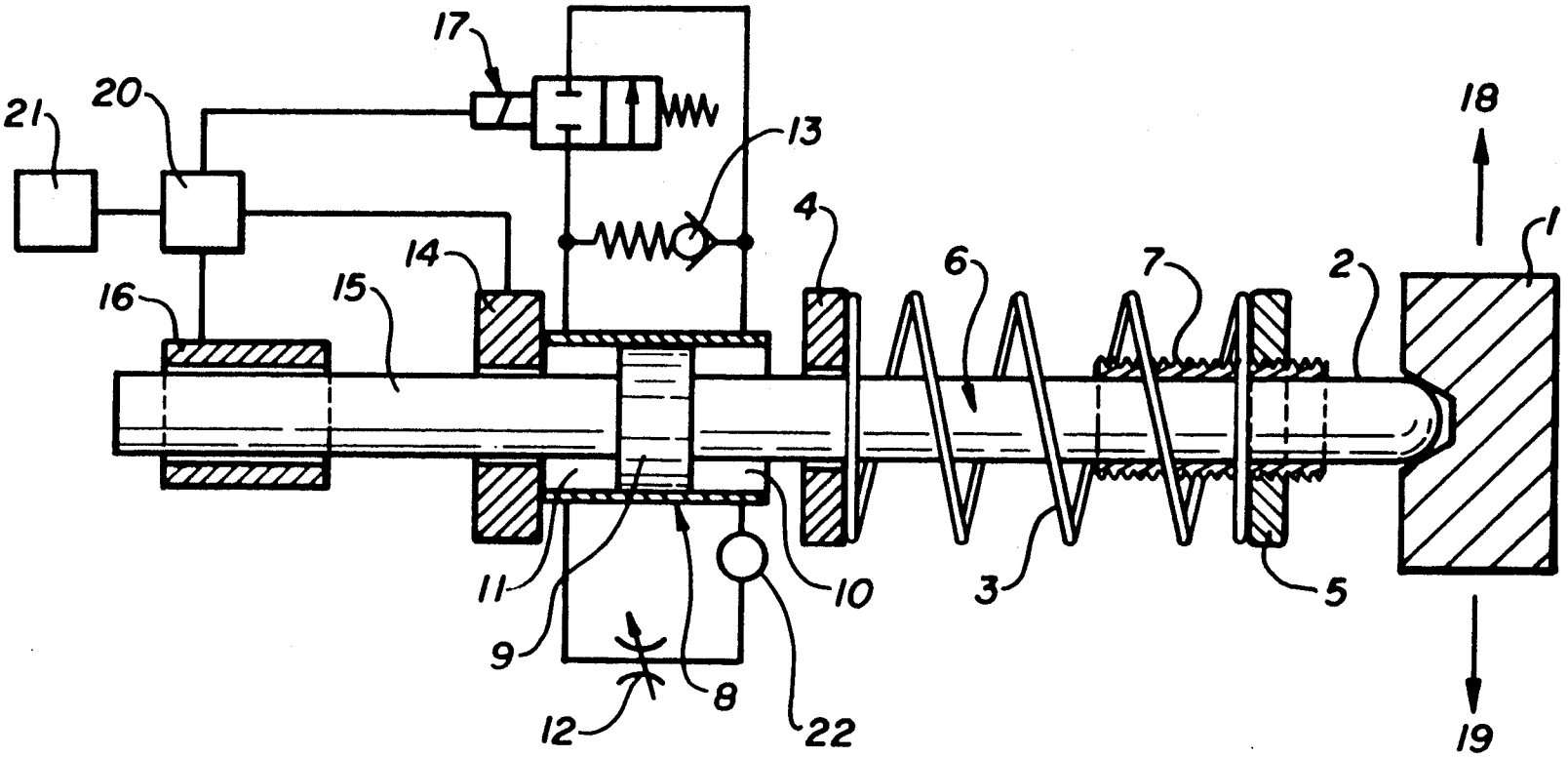
FIG. 1 is a schematic drawing of the ski binding of the invention.

The connection of the ski boot with the ski may be in any desired conventional manner. Thus, by way of example, FIG. 1 shows a part 1 which is fixedly connected, but in a manner allowing non-automatic detachment from the ski boot (not illustrated) when intended. In a way which is also previously known, this part possesses release cams adapted to cooperate with a catch member 2 which is acted upon by a release spring 3. The latter bears against an abutment 4 which is fixedly connected with the ski (also not shown). By modifying the biasing action of the release spring through adjustment of the nut 5 which serves as a spring abutment plate, it is possible to vary the release force of the safety ski binding in a conventional manner.

The catch member 2 is constituted by the free end of a piston rod 6 which is adjoined to the piston rod by a section 7, having a screw thread for engaging the nut 5. This piston rod extends into a cylinder 8 and merges into, or is connected with a piston 9 which is able to slide in the cylinder. Like the abutment 4, the cylinder is arranged to be fixed in relation to the ski. In the cylinder the piston forms two cylinder chambers 10 and 11. The same are connected by means of a choke 12, which is preferably able to be set non-automatically, i.e., as desired by the skier. Furthermore, there is a check valve 13 in a duct connecting the two cylinder chambers. In the end wall of the cylinder 8, remote from the catch member 2, there is a pressure measuring device 14. A second piston rod 15 extends out through the end wall of the cylinder 8 to a displacement measuring device 16.

In accordance with this embodiment of the invention, there is a bypass duct for the duct that contains the check valve 13, and for the choke 12, the bypass duct containing an electromagnetic valve 17. Like battery 21, electromagnetic valve 17 is associated with electronic circuitry 20, which is of a conventional type and does not form the present invention, per se. For this reason electronic circuitry 20 is not described in detail. Circuitry 20 responds to signals generated by the devices 14 and 16, which for their part are responsive to the forces acting on the leg of the skier.

FIG. 1 shows the safety ski binding in a horizontal setting. The catch member 2 thus responds to loads which act on the part 1 in the plane of FIG. 1, both in the direction of arrow 18, and also in the direction of arrow 19, as well as upwards out of the plane of the drawing. The catch member may also be said to respond to forces which can be expressed in terms of their respective force components. The release cams in part 1 are designed in accordance with the desired relationship of such forces.

As noted, the transducers 14 and 16 detect the forces acting at the catch member 2 on piston rod 6, which in turn responds to forces acting on the binding. The signals furnished by the transducers are compared by electronic circuitry, with a threshold value established in accordance with the desired release characteristic. Should the threshold value be attained, the electromagnetic valve 17 is opened so that there is more or less a collapse of the shock absorber resistance. Ensuing release can then be brought about by overcoming the resistance of the release spring 3.

In order to take care of the possibility of a failure in the circuitry, for example, in the electromagnetic valve or in the current supply, i.e., a power failure, the safety ski binding maintains an approximately constant release characteristic. It will then function purely hydromechanically, which is important, especially in regard to the dynamic loads occurring.

In the embodiment of the invention described in the preceding, the part 1 constitutes a single functional unit with the ski boot, whereas the parts 4 and 8 are arranged to be fixed in relation to the ski. However, as a further embodiment, the invention also contemplates a design in which, unlike the binding described, the binding is accommodated with the parts 4 and 8 being located in a ski boot sole, or alternatively, in a special purpose sole plate to be connected with the ski boot, in which latter case the part 1 is fixed on the ski, or is only capable of being non-automatically moved thereon.

It is naturally possible for the part 1 to be designed as a conventional sole holder for gripping the sole at one end, and for it to be suitably mounted so that it may be moved on a part of the binding which is fixed in relation to the ski.

The embodiment of the invention described herein in detail is only shown schematically in FIG. 1. However, for a person of average skill in the art there would be no difficulty in producing alternative sturdy and compact designs. For example, this might be done by designing the shock absorber device to have a cylinder and piston arrangement, whose cylinder would be mounted on the piston so as to be able to slide in relation to the release spring. Then the choke, the check valve-containing duct, and also the bypass duct containing the electromagnetic valve would be incorporated in the piston. At the same time the free end of the cylinder would function as a catch member, and possibly in accordance with the previously described design, further constitute the sole holder.

Figure 2:
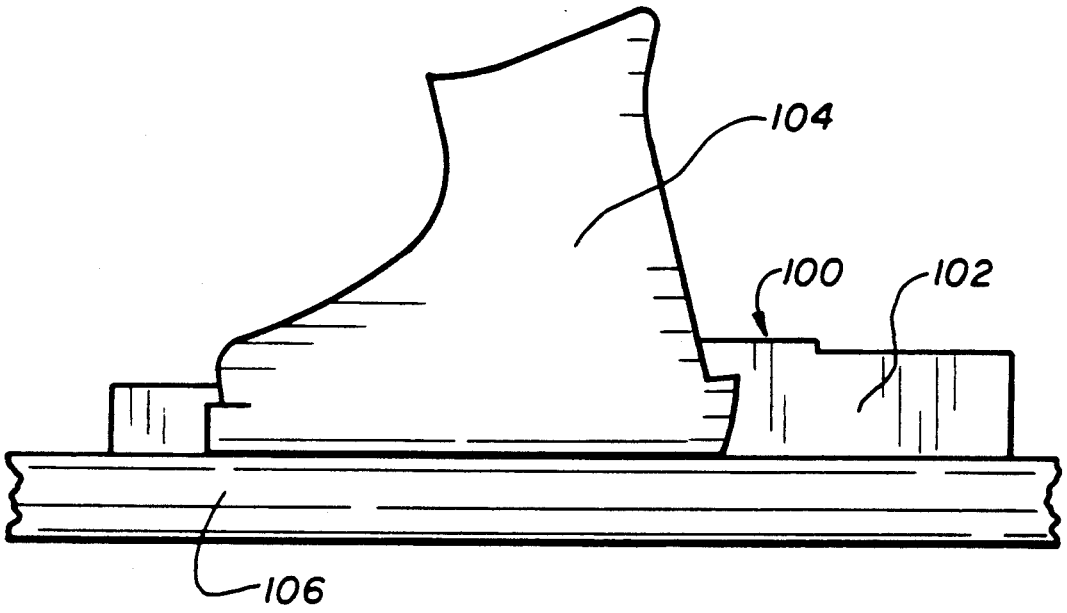
FIG. 2 is a schematic drawing of the present invention as part of an integrated system.

With respect to FIG. 1, it may be mentioned that in the duct leading to the cylinder chamber 10, adjoining the choke 12, there is also a pressure-limiting valve 22, which is of known design, valve 22 preferably being adjustable. Furthermore, there is also a suitable hydraulic accumulator between the pressure-limiting valve 22 and the cylinder chamber which may be of any suitable conventional design. This arrangement ensures that a rapid succession of blows or jerks will not lead to unintended release of the binding. FIG. 2 depicts the present invention as part of an integrated system including ski binding 100, shock absorbing means 102, ski boot 104 and ski 106.

While in accordance with the patent statutes, a preferred embodiment and best mode has been presented, the scope of the invention is not limited thereto, but rather is measured by the scope of the attached claims.

What is claimed is:

1. A safety ski binding connectable to a ski, said ski binding having a closed position bar releasably holding a ski boot and an open position for releasing the ski boot, and comprising:

shock absorbing means comprising:

hydraulic circuit means for putting said ski binding in the open and closed position and for controlling the shock forces acting on said binding, said hydraulic circuit means including:

cylinder means having surfaces defining an interior bore;

piston means mounted for relative movement in said interior bore of said cylinder means, movement of said piston means by a predetermined amount enabling the opening of said ski binding;

choke means operatively connected to said cylinder means across said piston means for regulating the hydraulic resistance to the relative movement of said piston means;

check valve means operatively connected to said cylinder means across said piston means for selectively allowing the flow of the hydraulic fluid in one direction;

detection means for generating a signal when the ski binding receives a force of a predetermined amount; and bypass means actuable to enable the hydraulic fluid to leave said cylinder means and for collapsing the hydraulic resistance to the movement of said piston means in response to the generation of said signal by said detection means.

2. A safety ski binding for releasably holding a ski boot; said binding receiving external forces from a ski boot attached to said binding, said binding having a releasing condition and a holding condition and comprising:

force detection means for sensing forces from the ski boot;

shock-absorbing means comprising:

hydraulic circuit means operatively connected to said force detection means, said hydraulic circuit means comprising:

cylinder means and piston means mounted for sliding movement in said cylinder means in response to forces received by the binding from the ski boot;

movement of said piston means relative to said cylinder means by a predetermined amount enabling said binding to go to the releasing condition;

choke means operatively connected to said cylinder means across said piston means for controlling the hydraulic resistance to the relative movement of said piston means;

check valve means operatively connected to said cylinder means across said piston means for selectively allowing the flow of hydraulic fluid in one direction in said cylinder means;

bypass means having bypass valve means actuable to enable the hydraulic fluid to leave said cylinder means and for collapsing the resistance of said shock absorbing means whereby said cylinder means and said piston means enable the binding to go to the releasing condition; and detecting means for detecting the occurrence of release forces acting on said binding, and for actuating said bypass valve means when said release force occurs; and spring means for biasing the binding to the releasing condition upon enablement by said cylinder means and said piston means.

3. A safety ski binding according to claim 2 wherein said cylinder means comprises:

a cylinder; and said piston means comprises:

a piston positioned in said cylinder and slidable relative thereto; and a piston rod for receiving forces responding to the external forces received by said binding and for opening the binding, said piston rod being attached to said piston and said spring means urging said piston rod to open the binding.

4. A safety ski binding according to claim 3 in which said detecting means comprises:

transducer means for detecting external forces acting on said binding;

an electromagnet for operating said bypass valve means;

electronic circuitry for activating said electromagnet; and a battery for energizing said detecting means.

5. A safety ski binding according to claim 4 in which said transducer means includes at least one transducer which detects the external forces acting on said binding, said one transducer generating signals corresponding to the external forces, and said electronic circuitry including means for comparing said signals with pre-determined reference values based on desired binding release characteristics.

6. A safety binding according to claim 3 in which said piston divides said cylinder into two spaced-apart chambers;

said choke means comprising a duct connecting said chambers and having a choke therein;

said check valve means comprising a duct connecting said chambers and having a check valve therein; and said bypass valve means comprising a duct connecting said chambers and having an electromagnetic shut-off valve therein.

7. A safety binding according to claim 6 in which said choke comprises adjustable means to control the flow of said hydraulic fluid through the duct within which said choke is located.

8. A safety ski binding according to claim 2 in which said spring means is mounted in said ski boot.

9. A safety ski binding according to claim 2 in which said spring means is an adjustable tensionable spring, to vary said biasing force.

10. A safety ski binding connectable to a ski, said binding comprising:

a sole holder for attaching a ski boot;

shock absorbing means comprising:

hydraulic circuit means for operating said sole holder, said hydraulic circuit means comprising:

a cylinder;

a piston positioned within said cylinder, dividing said cylinder into two chambers and slidable relative to said cylinder;

a piston rod connected to said piston;

choke means including a duct connecting said chambers and having a choke therein;

check valve means including a duct connecting said chambers and having a check valve therein;

bypass means comprising a duct connecting said chambers and having a shut-off valve therein; and detecting means for detecting forces acting on said binding, and for opening said bypass means when a predetermined force acts upon said binding, said detecting means comprising:

at least one transducer for detecting forces operating on said binding;

an electromagnet for operating said bypass means;

electronic circuitry for activating said electromagnet; and a battery for energizing said detecting means.

* * * * *